US006079984A

United States Patent [19]

Torres et al.

[11] Patent Number: 6,079,984

[45] Date of Patent: Jun. 27, 2000

[54] EDUCATIONAL SYSTEM AND METHOD OF USING SAME

[76] Inventors: Cheri B. Torres, 1694 Munsey Hatcher Rd., Seymour, Tenn. 32865; Carolyn R. Morton, 2111 Ludwick, Maryville, Tenn. 37803; Tom L. Carter, 1693 Sturbridge Dr., Sewickley, Pa. 15163

[21] Appl. No.: 08/884,645

[22] Filed: Jun. 27, 1997

Related U.S. Application Data

[60] Provisional application No. 60/020,889, Jun. 28, 1996.

[51] Int. Cl.[7] ..... A63B 71/00

[52] U.S. Cl. ..... 434/247; 273/440; 482/910

[58] Field of Search ..... 434/247, 255, 434/258; 273/440, 449, 453, 441, 444; 482/34, 35, 910

[56] References Cited

U.S. PATENT DOCUMENTS

| | | | |
|---|---|---|---|
| 1,537,686 | 5/1925 | Lynn | 472/48 |
| 1,815,443 | 7/1931 | Mitchell | 434/250 |
| 2,323,291 | 7/1943 | Bens . | |
| 2,837,837 | 6/1958 | Castle | 434/250 |
| 2,883,192 | 4/1959 | Royston | 482/36 |
| 3,062,542 | 11/1962 | Evancha | 482/34 |
| 3,339,920 | 9/1967 | Moritz . | |
| 3,485,493 | 12/1969 | Pitkanen | 482/34 |
| 3,545,747 | 12/1970 | Thomas | 273/449 |
| 3,547,435 | 12/1970 | Scott | 482/34 |
| 3,558,133 | 1/1971 | Reiner . | |
| 3,580,568 | 5/1971 | Stone | 482/34 |
| 3,761,084 | 9/1973 | Dieckman . | |
| 3,933,353 | 1/1976 | Marsh . | |
| 4,378,112 | 3/1983 | Goldstein | 482/34 |
| 5,156,409 | 10/1992 | Barnes | 273/444 |
| 5,242,175 | 9/1993 | O'Leary . | |
| 5,248,152 | 9/1993 | Timmerman | 273/444 |
| 5,389,054 | 2/1995 | Dorman | 482/34 |
| 5,393,074 | 2/1995 | Bear et al. . | |
| 5,405,304 | 4/1995 | Petersheim et al. | 482/35 |
| 5,554,074 | 9/1996 | Von Parrish | 472/116 |
| 5,584,779 | 12/1996 | Knecht et al. | 482/8 |
| 5,616,102 | 4/1997 | Lahmann | 482/34 |

*Primary Examiner*—Paul J. Hirsch
*Assistant Examiner*—Michael B. Priddy
*Attorney, Agent, or Firm*—Shlesinger, Arkwright & Garvey LLP

[57] ABSTRACT

A portable system for multiple educational activities includes multiple planks and connectors and allows for the arrangement of the planks and connectors in different configurations to enable use for a variety of activities. One of the activities requires four planks be configured in a square shape with the connectors attached to the ends of two of the planks thereby allowing sliding engagement with slots in the sides of the other two planks. A second activity requires two planks be attached at one end via a pivot joint which allows for variation of the angle between the planks. Also provided is a method for using the portable system.

29 Claims, 12 Drawing Sheets

FIG. 1

Goal Reference Matrix

| ACTIVITY | Achievement/Motivation | Boundaries | Caring | Change | Collaboration/Cooperation | Communication | Conflict Resolution | Courage/Encourage/Discourage | Creativity/Innovation | Critical Thinking | Decision Making | Expectations/Perceptions | Flexibility | Followership | Leadership | Learning Organization | Listening | Organization | Perseverance | Planning | Problem Solving | Self-Awareness | Self-Confidence/Self-Esteem | Sharing Leadership/Information | Stress Management | Support | Teamwork | Trust | Values | Vision/Purpose |
|---|---|---|---|---|---|---|---|---|---|---|---|---|---|---|---|---|---|---|---|---|---|---|---|---|---|---|---|---|---|---|
| All Aboard | X | | | | X | | X | | X | | | | | | | | | | | X | | | X | | X | X | | X | X | |
| Adding Machine | | X | X | X | | | | | | | X | | X | | | | X | | X | X | | | | X | X | | X | | | |
| Alphanumeric Challenge | | X | X | X | | | | | | | X | | X | | | | X | | X | X | X | | | X | X | | X | | | |
| Amoeba Walk | | | | X | | X | | | | | | | X | X | X | | X | X | | X | | | | X | | | X | | | |
| Big Foot | | | X | | X | X | X | X | | | | | | X | X | X | X | | X | | | X | X | X | | X | X | | | |
| Blindfold Walk | | | X | | | X | | X | X | | | X | | X | X | X | X | | | | | | X | X | | | | X | | |
| Blind Polygon | | | | X | | X | | | | | | X | X | | X | | X | X | | | | | | X | | | X | | X | X |
| The Box | X | | | | X | X | X | | X | | | | X | | | | | | | X | X | | X | | | X | | X | | |
| Doctor! Doctor! | | | X | | | | | | X | | | | X | | X | | | | X | X | X | | | | X | X | | X | | |
| Boxed Bridge | | X | X | | X | X | X | | | | | | X | | | X | X | | X | X | X | | | | | | | X | | |
| Lost Coin | | | | | | | | | | | | | X | | | | | | X | | X | | | X | | X | | | | |
| Out of the Box | | | | | X | X | | | X | X | X | | X | | | | X | | X | X | X | | | X | | | X | | | |
| The Bridge | | X | X | | X | X | X | | | | | | | | | | X | | X | X | | | | | | | | X | | |
| Islands | | | | | | X | | | | | X | | | | | X | X | | | | X | | X | X | | | X | | | |
| Quicksand | X | X | | | | X | X | | | | X | X | | | X | | X | | X | X | X | | | X | | | | X | | |
| Paradigm Shifter | | | | | X | | | | X | X | | X | | | | X | | | | | X | X | | X | | X | X | | X | X |
| Spider Web | X | X | X | | X | | | X | | | X | | X | X | | | | | X | X | X | X | X | | | X | | X | | |
| Space Launcher | | X | | | | X | X | | X | | X | | | | | | | | | X | X | | | | | X | X | X | | |
| Chaos Toss | | | X | X | X | X | | | | | | X | | | | | | | | | | | | | X | X | X | | X | |
| Speedball | X | X | | | | X | X | | X | X | | X | X | | | X | | | | X | X | | X | | X | | X | | | X |
| Trust Vee | | | X | | X | | | X | | | | X | | | | X | X | | X | | | | X | | | | X | X | | |
| Zig Zag/Swamp Walk | X | X | X | X | X | X | X | | | X | X | | X | X | X | | X | X | X | X | X | | X | X | | X | X | X | | X |
| Connection Walk | | | | | | X | | | | | | | | X | X | | | X | | | | | | X | | | | | | X |
| Skyhook | X | X | | | | | | | | X | | X | | | | | X | | | | X | | | | | | | | | |

FIG. 2

The Twelve Steps

Step one confronts the paradox of our addictive and coaddictive processes. We feel powerful when, in fact, we are powerless and need help.

Step two challenges our grandiosity and reminds us that we are limited human beings.

Step three underlines our efforts to control when we need to take responsibility only for ourselves and leave the rest to our Higher Power.

Step four takes the energy out of shame that seperates us from ourselves, others, and our Higher Power. It brings acceptance.

Step five asks us to break through the paralyzing fear that prevents us from receiving forgiveness and faith.

Step six attacks our perfectionism, allowing us to experience our wounds so that we might heal.

Step seven asks us to give up our willfulness so that we might allow change to work in our lives and to begin grieving.

Step eight asks us to exchange our pride for honesty.

Step nine challenges us to stop seeking approval and to pursue integrity by making amends for harm we have caused.

Step ten makes a daily prescription to set aside our defenses and admit our errors.

Step eleven asks us to trade the magical thinking of escapism for the realities of a spiritual life even though they are difficult.

Step twelve tells us to trade in our martyrlike victim roles and share the changes in our lives with others with similar problems.

FIG. 3

MTC™ Activity

1. CHAOS TOSS
2. SPEEDBALL
3. PARADIGM SHIFTER
4. BLINDFOLD WALK
5. BLIND POLYGON
6. ALL ABOARD
7. CONNECTION WALK
8. AMOEBA WALK
9. ADDING MACHINE
10. ALPHANUMERIC CHALLENGE
11. QUICKSAND/MINEFIELD
12. ISLANDS
13. BIGFOOT
14. THE BOX
15. DOCTOR! DOCTOR!
16. BOXED BRIDGE
17. LOST COIN
18. OUT OF THE BOX
19. TRUST VEE
20. SPIDER WEB
21. THE BRIDGE
22. ZIG ZAG/ SWAMP WALK
23. SPACE LAUNCHER
24. SKY HOOK

FIG. 4

Rehabilitation Goal Matrix

| The Twelve Steps | | | | | | | | | | | | | MTC™ Activity | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | Concepts | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
| | X | | | | | | | | | | | boundaries and limitations | | X | | | | | | | X | X | X | | | | | X | | | | X | X | X | X | X |
| | | | | X | | | X | X | | | X | caring | X | | | X | | | | | X | X | | | X | | X | X | | | X | X | X | X | | |
| X | X | X | | | X | X | | | | X | | change | X | | | | X | | | X | X | X | | | | | | | | | | | | X | | |
| | X | | | | X | X | | | | X | | collaboration/cooperation | X | | X | | | X | | | | | | | X | X | | X | | X | X | X | X | X | | |
| | | | | | | | | | X | | X | commitment | | | | | | X | | X | | | X | | | | | | | | X | | | | | |
| | | | | X | | X | | X | | | | communication | X | X | | X | | | X | X | | | X | X | X | X | | X | | X | | | X | X | X | |
| | | | | | | | | X | | | | conflict resolution | | X | | | | X | | | | | X | | X | X | | X | | | | | X | X | X | |
| | | | | | X | | | | | X | | control | | | | | | | | | | | | | | | | | | | | | | | | |
| X | X | X | X | X | X | X | | | | X | | courage | | | | X | | | | | | | | | X | | | | | | X | X | | | | |
| | | | X | | | | | | | | | critical thinking | | X | X | | | | | | | | | | | | | | | X | | | | X | | X |
| X | | X | | | X | | | | | | | decision making | | | | | | | | | X | X | X | X | | | | | | X | | X | | X | X | |
| | | | X | | | | | | | | | feedback | | X | | | X | | X | | | | X | | X | | | | | | X | | | X | | |
| | | | | | | X | | | | | | flexibility | | X | | | X | | | X | X | X | | | | X | X | X | X | X | | X | | X | | |
| | X | | | | | X | | | | X | | followership | | | | X | | | X | X | | | | | X | | | | | | | X | | X | | |
| | | | | | | X | | | | | | growth/development | X | | X | X | | X | | | | | X | | X | | | X | | | X | X | X | X | | |
| | | | | | | X | | | | | | humility | | | | X | | | X | X | | | | | X | | | | | | | X | | | | |
| | | | | | | X | X | X | X | | | integrity/honesty | X | | X | X | | | X | | | | | | | | | | | | X | X | | | | |
| | | | | | | | | | | | X | leadership | | | | X | X | | X | X | | | X | | X | | X | | | | | | | X | | |
| | X | X | X | | | X | | | | X | | listening | | | | X | X | | | X | X | X | X | X | X | | | X | | X | X | | X | X | | X |
| | | | | | X | | | | | | | motivation | | X | | | | X | | | | | X | | | X | | | | | | X | | X | | X |
| X | X | X | | | | X | | | X | | | perception | X | X | X | X | X | | | | | | X | | | | | | | | X | | | | | X |
| | | | | X | | | | | | X | X | perseverance | | | | | | | | | X | X | X | | X | | X | X | X | X | X | X | X | X | | |
| | | | | | | | X | | | | | planning | | X | | | | X | | X | X | X | X | | | X | X | X | | | | X | X | X | X | |
| X | | | | | | | | | | | | powerlessness | | | | X | | | | | | | X | | | | | | | | X | X | | | | |
| | | | | | | | | | X | | | problem solving | | X | X | | | | | | | X | X | X | | X | X | X | X | X | | X | | X | X | X |
| | | | | | | | X | | | | X | relationships-healing/building | | | X | X | | | X | | | | | | X | | X | | | | X | X | | X | | |
| X | | | | | | | | | | | | self-admission | X | | X | | | | | | | | | | | | | | | | | X | | | | |
| | X | | X | | | | X | | X | | | self-awareness | | | X | | | | | | | | | | X | | | | | | | X | | | | |
| | | | | | | | | | X | | X | self-confidence | | X | | X | | X | | | | | | X | X | X | | | | | X | X | | X | | |
| | | | | | | | | | | | X | sharing leadership/information | | | X | | X | | X | X | X | X | X | X | X | | | | X | X | | | | X | | |
| | X | X | | | X | X | | | | X | X | support | X | | X | | | X | | | | | X | | X | X | X | | X | | | X | | X | X | |
| | | | | | | | | | | | X | teamwork | X | X | X | | X | | | X | X | X | X | X | X | | | | | X | X | | | X | X | |
| | X | X | | X | X | | | X | | X | | trust/openess | | | | X | | X | | | | | | | | X | | X | | | X | X | X | X | X | |
| X | | | | | | | | | | | | truth | X | X | X | X | | | X | | | | | | | | | | | | X | | | X | | |
| | | | X | | | | | | X | | | values | X | | X | | X | X | | | | | X | | | | | | | | | | | | | |
| | | X | | | | | | | X | | X | vision/purpose | | X | X | | X | | X | | | | X | | | | | | | | | | | X | | |

FIG. 5

Basic Competencies

| | 1. Chaos Toss | 2. Speedball | 3. Paradigm Shifter | 4. Blindfold Walk | 5. Blind Polygon | 6. All Aboard | 7. Connection Walk | 8. Amoeba Walk | 9. Adding Machine | 10. Alphanumeric Challenge | 11. Quicksand/Minefield | 12. Islands | 13. Big Foot | 14. The Box | 15. Doctor! Doctor! | 16. Boxed Bridge | 17. Lost Coin | 18. Out of the Box | 19. Trust Vee | 20. Spider Web | 21. The Bridge | 22. Zig Zag | 23. Space Launcher | 24. Skyhook |
|---|---|---|---|---|---|---|---|---|---|---|---|---|---|---|---|---|---|---|---|---|---|---|---|---|
| **Resources** | | | | | | | | | | | | | | | | | | | | | | | | |
| Time | X | X | | | | | X | | X | X | | | | | | | | X | | X | | | | |
| Money | | | | | | | | | | | | | | | | | | X | | | | X | | |
| Materials/Facilities | X | | | | | | | | X | X | | X | | | | | | X | | X | | | X | X |
| Human Resources | | X | | X | | X | X | | X | X | | | | | | | | X | | X | | | X | |
| **Interpersonal** | | | | | | | | | | | | | | | | | | | | | | | | |
| Teamwork | X | X | X | X | X | X | X | X | X | X | X | X | X | X | X | X | X | X | X | X | X | X | X | |
| Service | X | | X | X | | | X | X | | | X | X | | | | X | | X | | X | | | X | |
| Teaching Others | X | | X | X | | | X | | X | X | X | X | X | X | X | | | X | X | X | X | | X | X |
| Leadership | | | | X | X | | X | X | | | X | | X | | X | | | | | | | X | | |
| Negotiation | X | | | | X | | X | X | | | | | X | X | | X | | | X | | X | | | |
| Working with Others | X | X | X | X | X | X | X | X | X | X | X | X | X | X | X | X | X | X | X | X | X | X | X | |
| **Information** | | | | | | | | | | | | | | | | | | | | | | | | |
| Acquisition and Evaluation | | X | | X | X | | X | X | X | X | | X | | | X | | | X | | | | X | | |
| Organization and Application | X | X | | X | X | X | X | | X | X | | | X | | | | | X | | X | X | X | X | |
| Interpretation and Communication | X | X | X | X | X | X | X | X | X | X | X | | X | X | | X | | X | X | X | | X | | X |
| Processing | X | | X | | X | | X | X | X | X | X | X | X | | | | X | X | | | | X | | X |
| **Systems** | | | | | | | | | | | | | | | | | | | | | | | | |
| Understand | X | X | | | | | X | | X | X | | X | | | | | | | X | X | | X | | X |
| Monitor/Correct | X | X | | X | X | X | X | X | X | X | X | | X | | | X | | X | | X | X | X | | |
| Recommend/Design | X | X | | | X | | X | | X | X | | | X | | | X | | X | | X | X | X | | |
| **Technology** | | | | | | | | | | | | | | | | | | | | | | | | |
| Selection | | | X | | | | | | X | | X | | | | | | | | X | | | X | | X |
| Application | | | | | | | | | | | X | | | | | | | | | X | | X | | X |
| Maintenance and Troubleshooting | X | X | | | | | X | | | | | | X | | | | | | | X | | | | |

FIG. 6

Foundational Skills

| | 1. Chaos Toss | 2. Speedball | 3. Paradigm Shifter | 4. Blindfold Walk | 5. Blind Polygon | 6. All Aboard | 7. Connection Walk | 8. Amoeba Walk | 9. Adding Machine | 10. Alphanumeric Challenge | 11. Quicksand/Minefield | 12. Islands | 13. Big Foot | 14. The Box | 15. Doctor! Doctor! | 16. Boxed Bridge | 17. Lost Coin | 18. Out of the Box | 19. Trust Vee | 20. Spider Web | 21. The Bridge | 22. Zig Zag | 23. Space Launcher | 24. Skyhook |
|---|---|---|---|---|---|---|---|---|---|---|---|---|---|---|---|---|---|---|---|---|---|---|---|---|
| Basic Skills | | | | | | | | | | | | | | | | | | | | | | | | |
| Reading | | | | | | | | | | X | | | | | | | | | | | | | | |
| Writing * | X | X | X | X | X | X | X | X | X | X | X | X | X | X | X | X | X | X | X | X | X | X | X | X |
| Mathematics | | | | | | | | | X | X | | | | | | | | | | | | | | |
| Listening | X | | | X | X | X | X | X | X | X | X | X | X | | | X | | X | X | X | X | X | | X |
| Speaking | X | | X | X | X | | X | X | | | X | X | X | | | | | | | X | | | | |
| Thinking Skills | | | | | | | | | | | | | | | | | | | | | | | | |
| Creative Thinking | | X | X | X | X | X | X | X | | X | | X | | X | X | X | | X | | | | | X | X |
| Decision Making | | | | X | X | X | X | X | X | X | X | X | | | | | | X | | X | | X | X | |
| Problem Solving | X | X | X | X | X | X | | X | X | X | X | X | X | X | X | X | X | X | | X | | X | X | X |
| How to Learn | X | X | X | X | | | | | X | X | | X | | | | | | | | X | | | | X |
| Reasoning | | X | | X | X | X | | X | X | X | | | | X | X | X | X | X | | X | X | X | X | |
| Personal Qualities | | | | | | | | | | | | | | | | | | | | | | | | |
| Responsibility | X | | X | X | X | X | X | X | | | X | X | | | X | | | X | | X | | X | | X |
| Self-Esteem | | | | X | | X | | | | | | X | X | X | | | | | X | X | | X | X | |
| Self Management | X | X | | | | | X | | X | X | | X | X | | X | | | | X | X | | | X | |
| Integrity/honesty | X | X | X | X | X | | X | | X | X | | | | | | | | | X | X | | | X | |

FIG.8
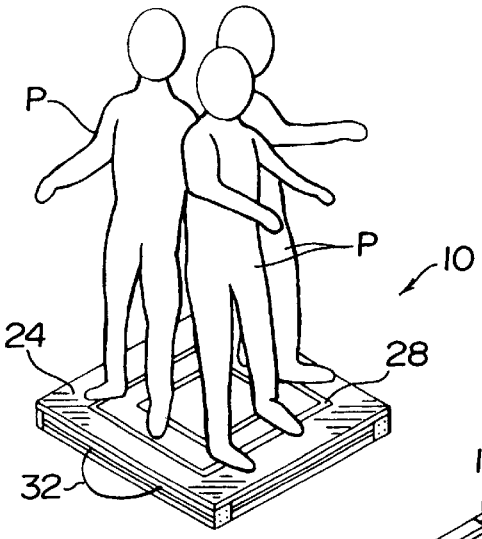
FIG. 7
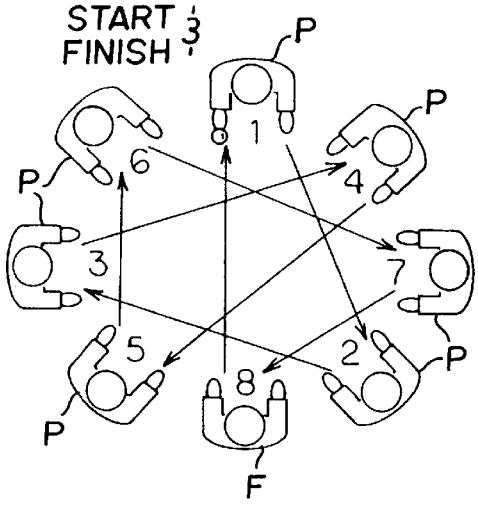
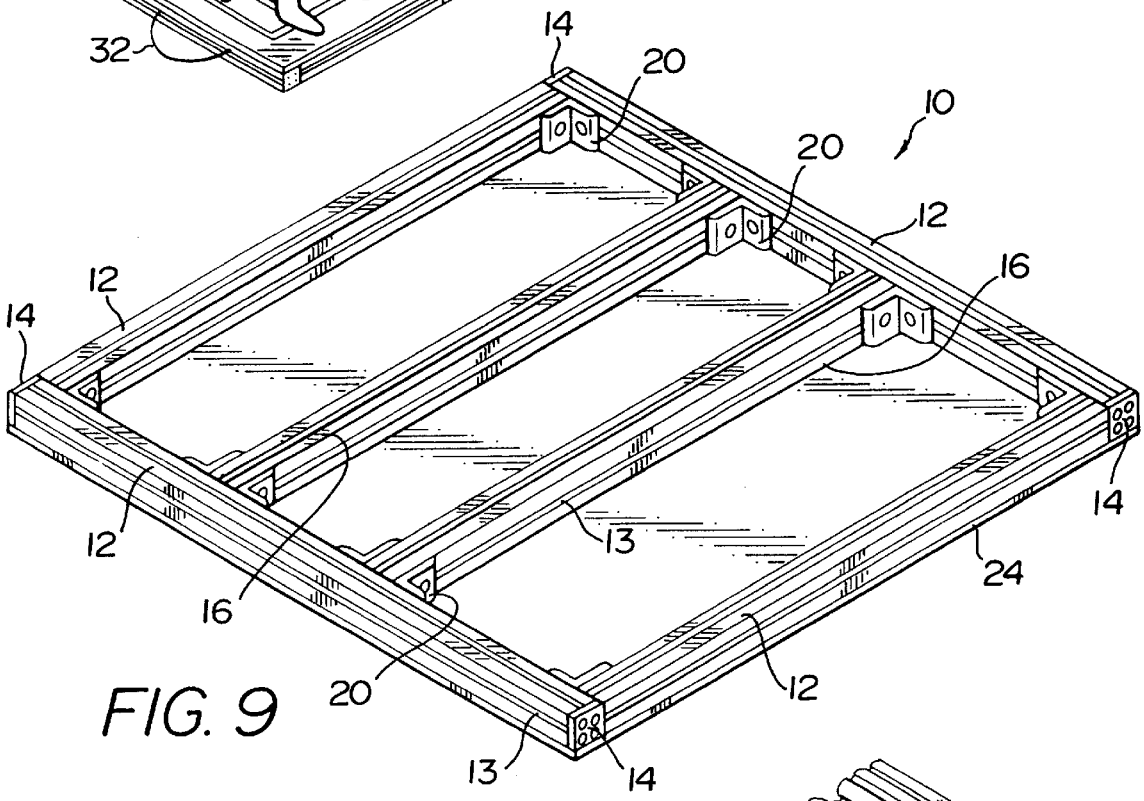
FIG. 9
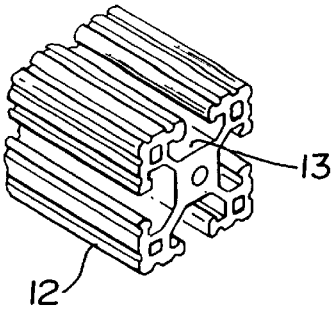
FIG. 10

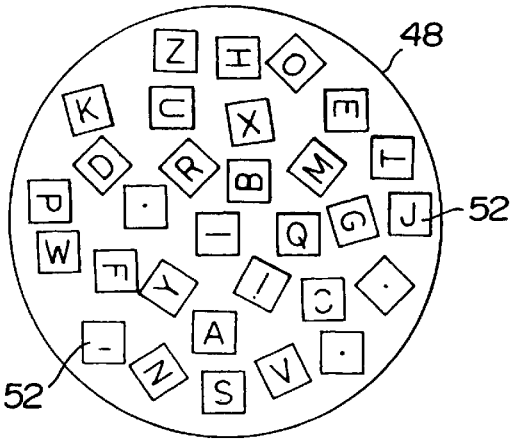
FIG. 12
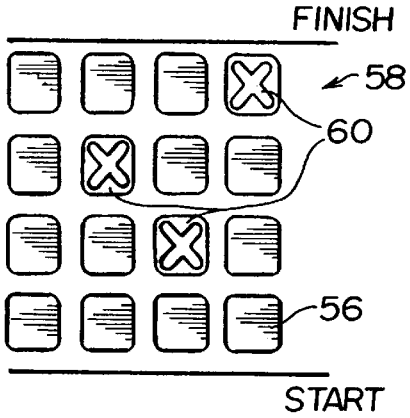
FIG. 13
FIG. 14
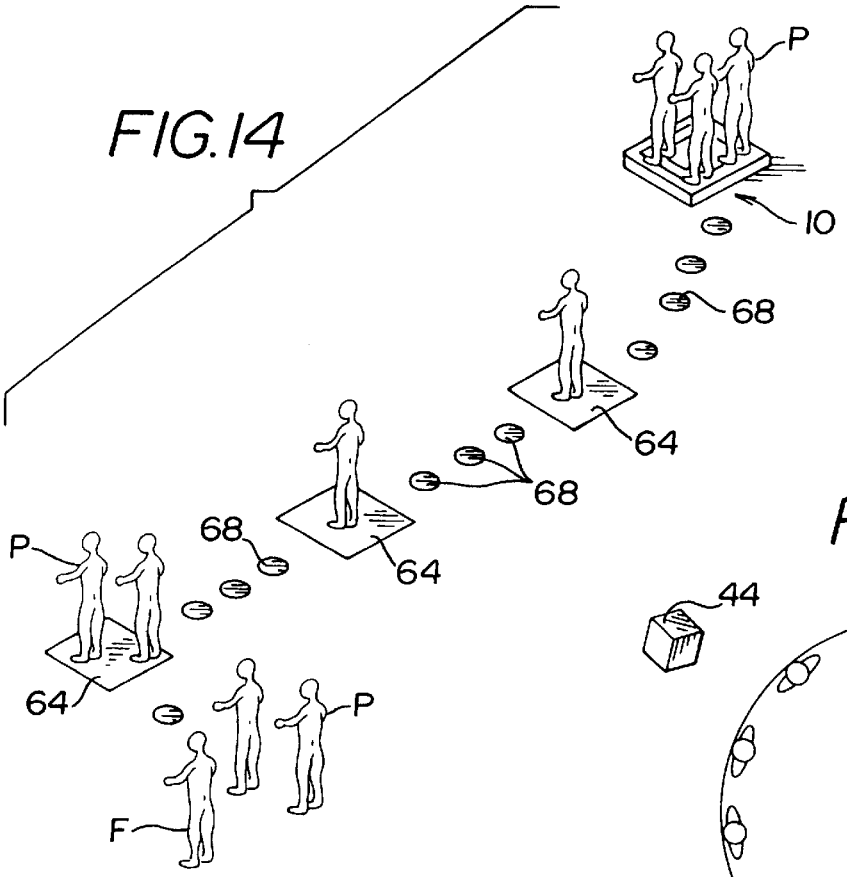
FIG. 11
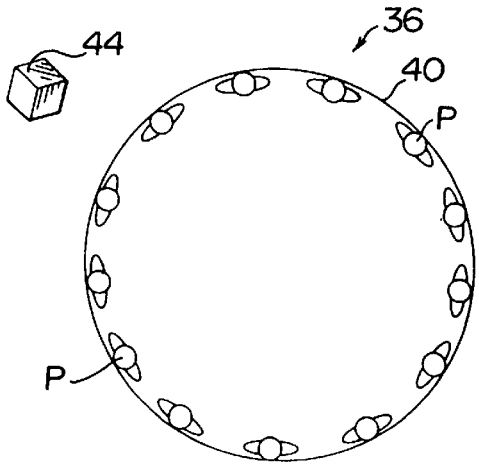

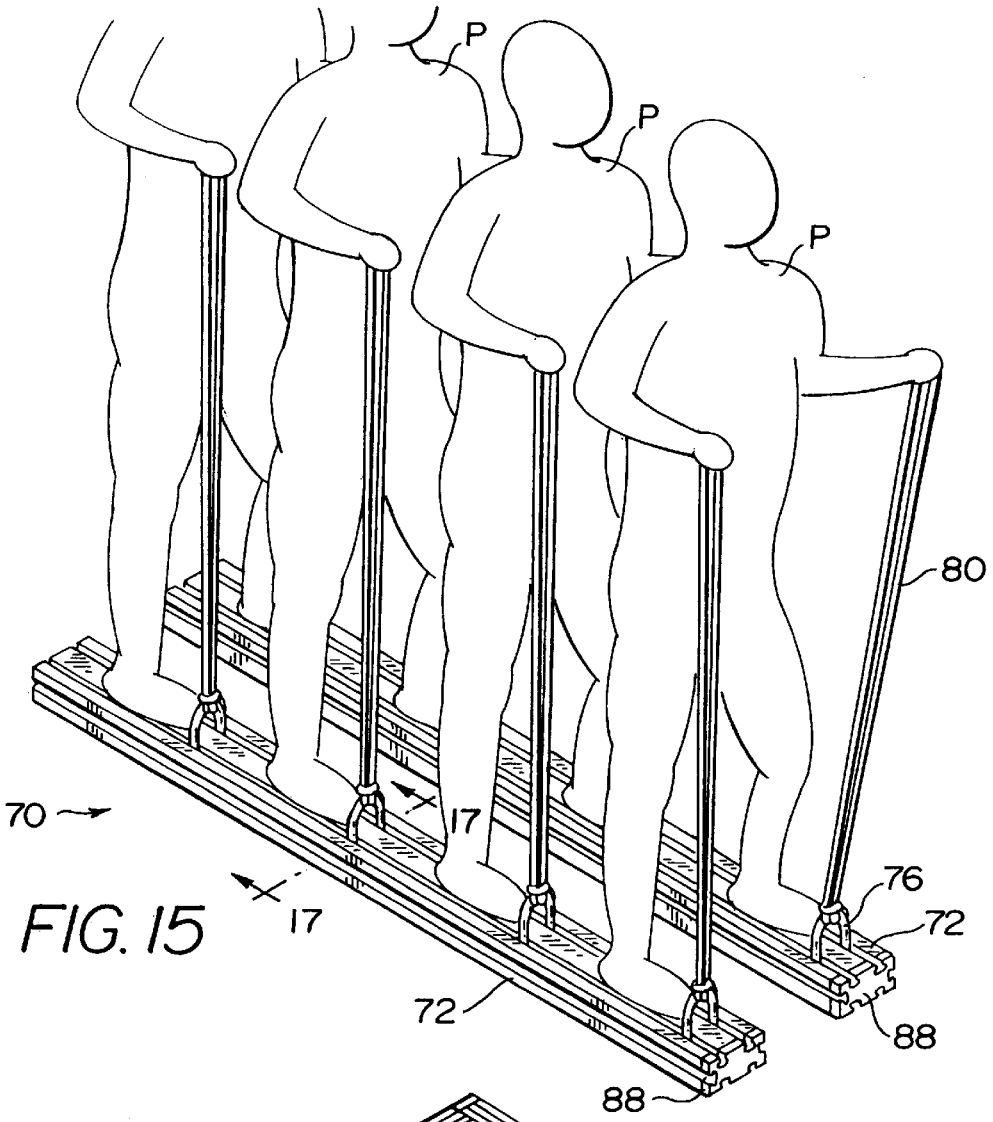
FIG. 15
FIG. 19
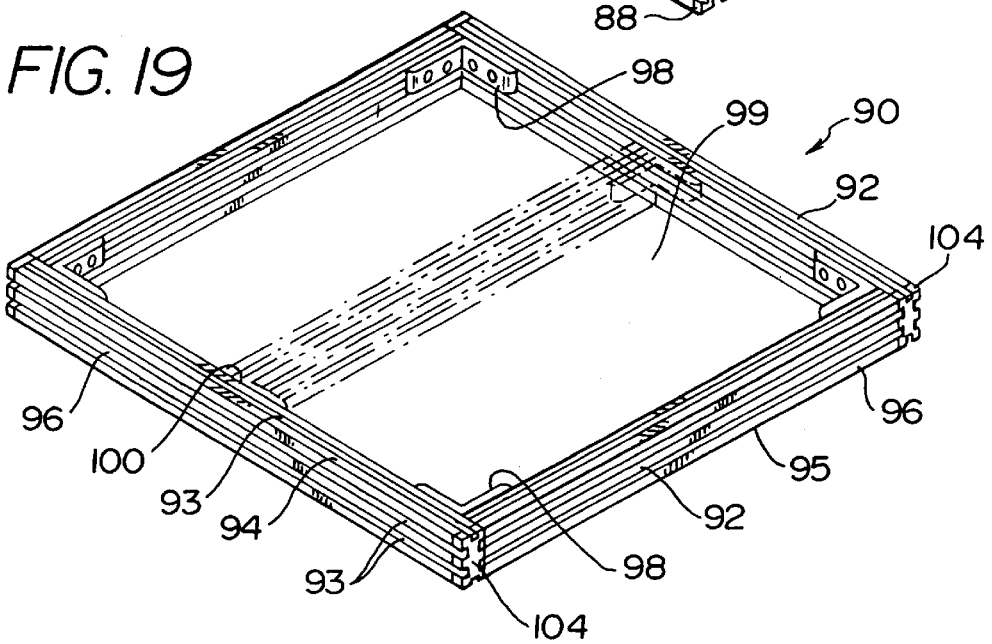

FIG. 16
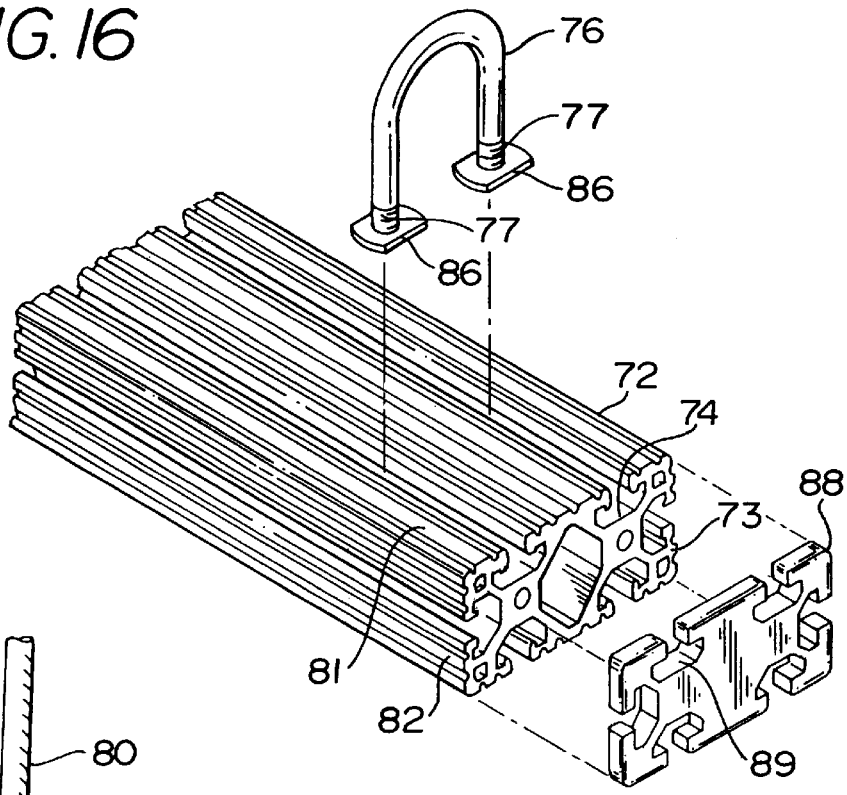
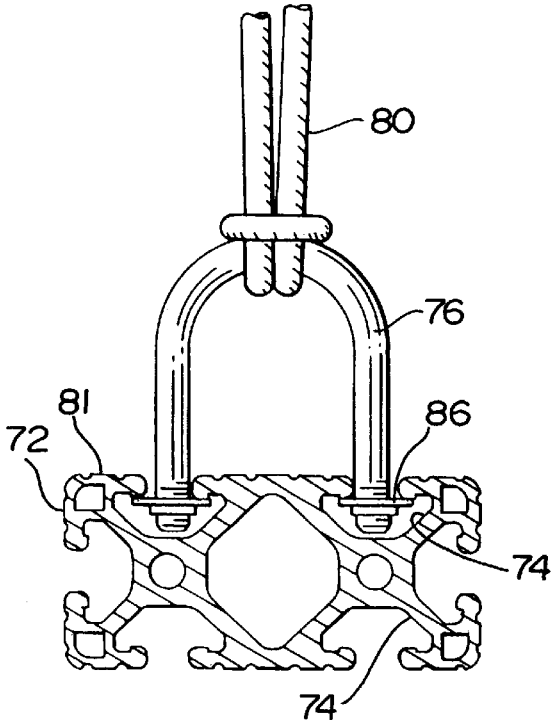
FIG. 17
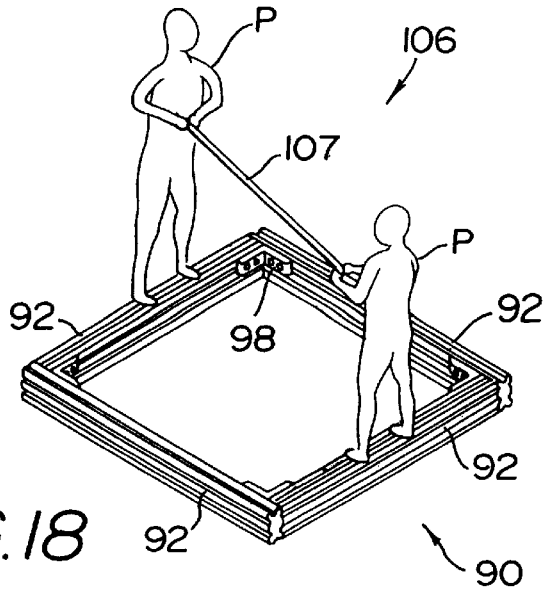
FIG. 18

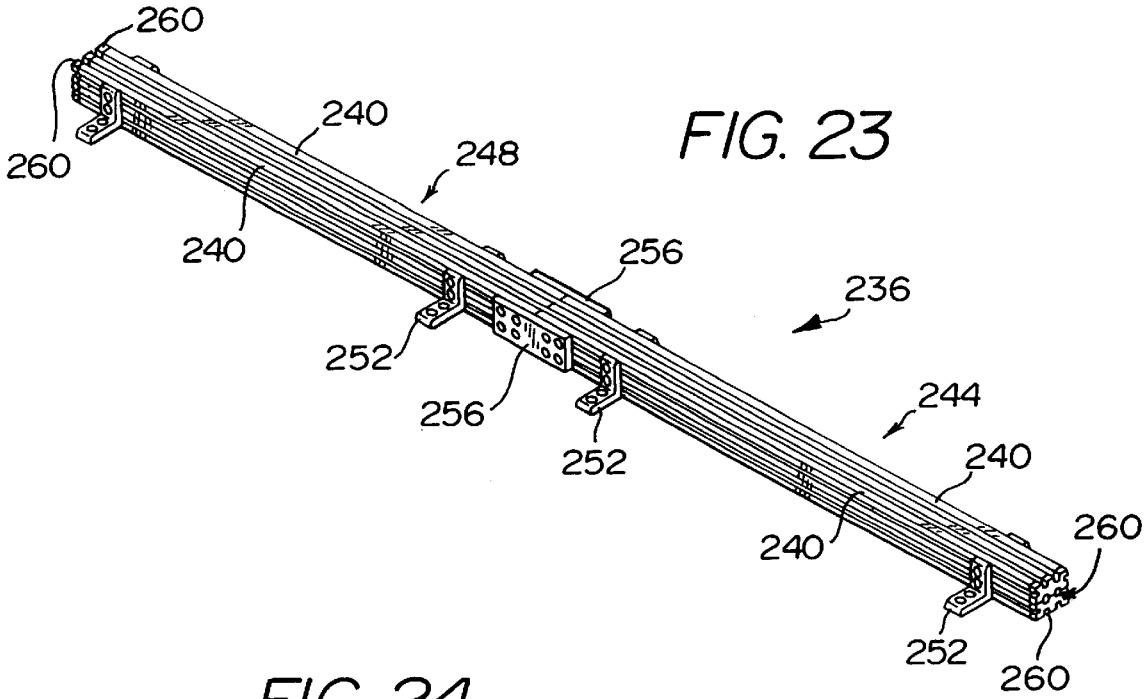
FIG. 23
FIG. 24
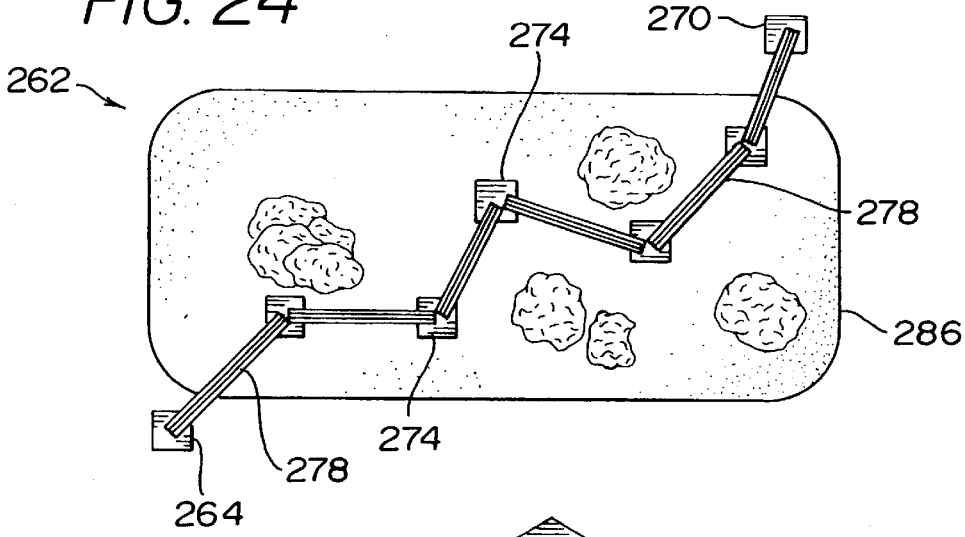
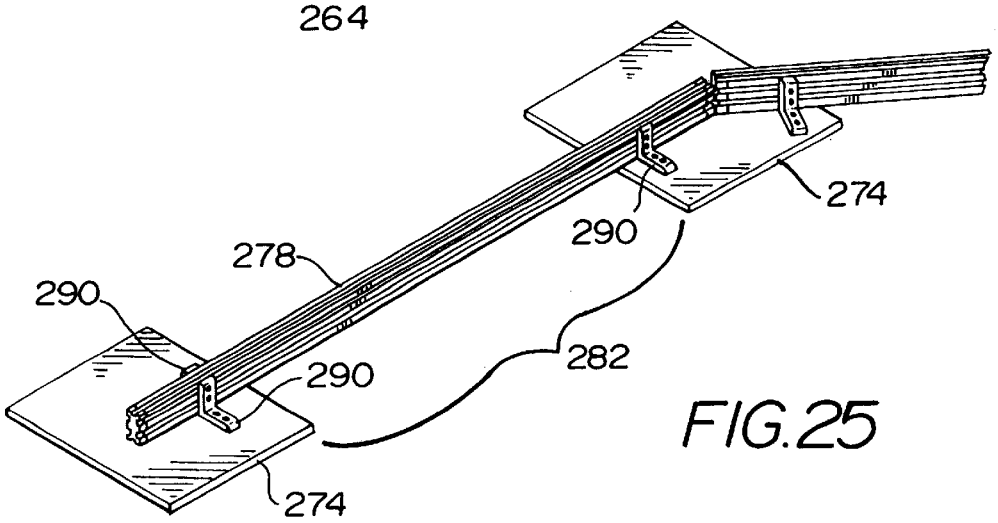
FIG.25

EDUCATIONAL SYSTEM AND METHOD OF USING SAME

This application claims the benefit of U.S. Provisional No. 60/020,889 filed Jun. 28, 1996.

FIELD OF THE INVENTION

This invention relates generally to mobile or portable, adventure-based interactive educational products, a system of using such, and a method of teaching individuals to facilitate their own course with such products.

BACKGROUND OF THE INVENTION

Adventure-based education, often referred to as a "ropes course", is typically a set of events or problem-solving activities designed to teach team building, trust, problem solving, leadership, and individual initiative and creativity.

Conventional devices, systems, educational equipment, methods of using the same, and methods of conveying the desired knowledge and skills to participants have numerous drawbacks. For example, some conventional systems are not mobile or portable and thus require participants to go to where the system is located. Other systems include activities or devices which are not environmentally friendly. Additionally, some systems include activities or equipment which are difficult to use and/or have an increased safety hazard for the participants.

Accordingly, there is therefore a need for an adventure-based educational system that is portable, light weight, easy to learn, environmentally friendly, and overcomes the drawbacks of conventional systems equipment and methods of utilizing and teaching the same.

OBJECTS AND SUMMARY OF THE INVENTION

An object of the present invention is to overcome the drawbacks of the existing devices and teaching methods.

Another object of the present invention is to provide a mobile or portable educational system which allows all of its activities to be easily transported or stored when not in use.

It is still another object of the present invention to impart the desired knowledge to the participants in a more effective way than with conventional equipment and methods, that not only enhances their experience in education in the short term, but also increases their retention of such learned material in the long term.

It is yet another object of the present invention to provide a portable educational system, which is environmentally friendly.

Yet a further object of the present invention is to provide a portable educational system which is inexpensive to manufacture and maintain.

Still a further object of the present invention is to provide an educational system having numerous activities that develop and teach to the participants ideas and values regarding: trust, team work, cooperation, change, flexibility, decision-making, planning, communication, problem-solving, leadership, support, perseverance, self-awareness and critical thinking.

It is another object of the present invention to provide a portable educational system, which an individual can own and operate at a location that he/she desires.

It is yet another object of the present invention to provide a portable educational system, which has a unique modular design that allows you to have a maximum number of activities with a minimum number of components and hardware.

It is another object of the present invention to provide a portable educational system which provides both flexibility and benefits such as ease of use.

It is still a further object of the present invention to provide a portable educational system, which is non-toxic and, where the participants do not need to concern themselves with getting splinters or infections from the equipment.

It is yet another object of the present invention to provide a system where the participants do not have to worry about exposure to wood preservatives or lifting of heavy equipment components.

It is another object of the present invention to provide a method of teaching and utilizing a portable educational system, which provides the owner thereof training that is designed specifically to focus on particular concepts that the owner desires.

In summary, the present invention provides a portable system for multiple educational activities comprising a zig zag exercising apparatus, a bridge exercising apparatus, an adjustable bridge box exercising apparatus, a trust vee exercising apparatus and a big foot exercising apparatus; and a method for utilizing the same, such as in an educational setting.

BRIEF DESCRIPTION OF THE DRAWINGS

FIG. 1 is a table identifying activities associated with our portable education system, and the corresponding concepts associated with the particular activity;

FIG. 2 is a table that identifies a twelve step rehabilitation program;

FIG. 3 is a table that lists by number and title, activities associated with our portable educational system;

FIG. 4 is a table entitled Rehabilitation Goal Matrix, drawing a correlation between the twelve rehabilation steps and the activities associated with our portable educational system through a listing of concepts associated with the steps and activities;

FIG. 5 is a chart entitled Basic Competencies, identifying the activities of our educational system and the corresponding characteristics associated with the activities or area of improvement;

FIG. 6 is a chart entitled Foundational Skills showing a correlation between the activities associated with our educational system, and the identified characteristics;

FIG. 7 is a schematic representation of diagram of an activity called chaos toss;

FIG. 8 is a perspective view of an activity entitled all aboard with participants shown in schematic form;

FIG. 9 is a bottom perspective view of the all aboard box;

FIG. 10 is a broken perspective view of an extrusion member used in the construction of the all aboard box;

FIG. 11 is a schematic representation of an activity entitled amoeba walk;

FIG. 12 is a schematic representation of activities entitled adding machine and alphanumeric challenge;

FIG. 13 is a schematic representation of an activity entitled quicksand or minefield;

FIG. 14 is a schematic representation of an activity entitled islands;

FIG. 15 is a perspective view of an educational apparatus entitled big foot, with participants shown thereon in schematic form;

FIG. 16 is an exploded broken perspective view of a portion of the big foot educational apparatus;

FIG. 17 is a cross sectional view taken along lines 17—17 of FIG. 15;

FIG. 18 is a perspective view of an education apparatus entitled adjustable bridge box, with participants shown thereon in schematic form;

FIG. 19 is a perspective view of the adjustable bridge box, illustrating in phantom lines how one side thereof may be adjusted to alter the area within the box;

FIG. 23 is a perspective view of a bridge educational apparatus;

FIG. 24 is a schematic representation of an educational apparatus entitled zig zag or swamp walk;

FIG. 25 is a broken perspective view of some of the components used in the zig zag apparatus;

DETAILED DESCRIPTION OF THE INVENTION

FIGS. 1–6

Figure 26:
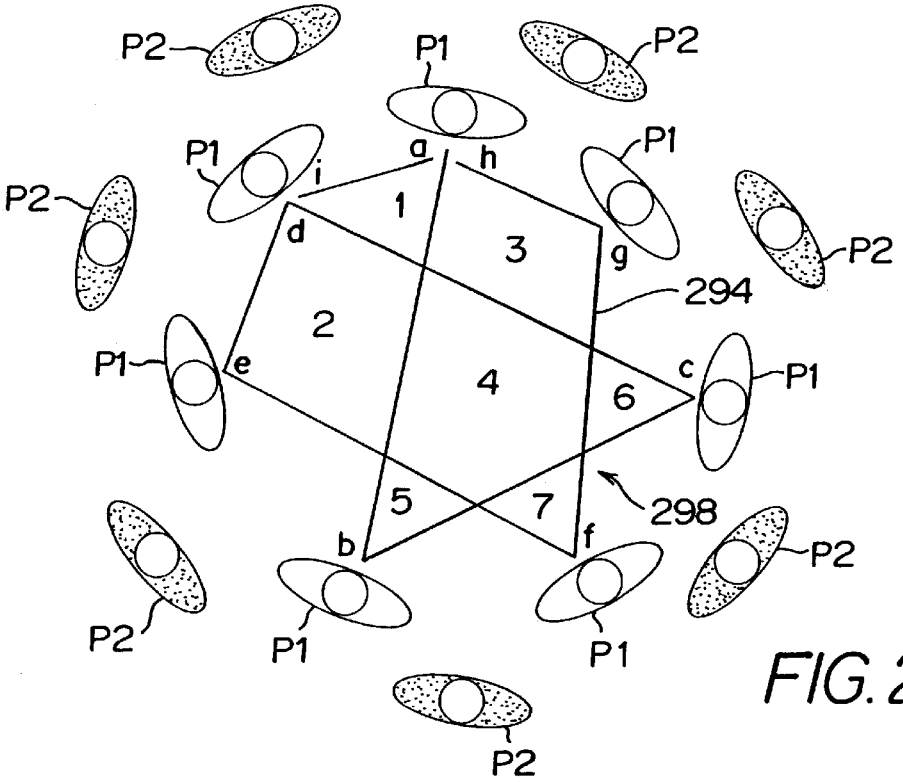
FIG. 26 is a schematic representation of an activity entitled space launcher.

The present adventure-based educational system comprises a set of materials and hardware that can be arranged to form various devices for numerous activities. FIG. 1 is a table, entitled "Goal Reference Matrix", identifying various activities associated with the present invention in the left most column. Across the top of the table is a list of some of the concepts to be improved or taught by the present educational system. For each activity an "x" is placed in the appropriate column to indicate the concepts that particular activity will improve.

With the "Goal Reference Matrix" an individual or group utilizing the present invention, as will be set forth below, can particularly adapt the present system to work on or improve particular concepts that the individual desires.

FIG. 2 is a table, entitled "The Twelve Steps". This table identifies the twelve steps set forth by Patrick Carnes, Ph.D., in his book *A Gentle Path Through The* 12 *Steps,* Haxelden Educational Materials, Center City, Minn., 1993. The twelve steps are utilized in rehabilitation programs.

FIG. 3 is a table of activities associated with our educational system. The activities will discussed further below.

FIG. 4 is a table entitled "Rehabilitation Goal Matrix". The numbers associated with the twelve steps in FIG. 2 and the numbers associated with the various activities in FIG. 3 are used in the table of FIG. 4. This "Rehabilitation Goal Matrix" can help determine which activities will be beneficial toward carrying out each of the twelve steps by matching the activities that are associated with a particular concept with a step that is also associated with the same concept. Individuals who are using the present system to assist in rehabilitating someone or a group will find this table useful to determine which activities to perform.

FIG. 5 illustrates which activities of the present invention should be utilized to enhance basic concepts regarding the following skills: resources, interpersonal, information, systems, and technology.

FIG. 6 illustrates which activities of the present invention should be utilized to enhance foundational skills.

FIGS. 7–27

Each of the above-identified activities will now be discussed.

FIG. 7 depicts an activity called chaos toss. Participants P and a group facilitator F stand in a circle facing each other.

Facilitator F tosses a ball, not shown, to one of participants P. Each participant P then tosses the ball to one another until each person has received the ball once. Facilitator is to be the last person to receiver the ball, i.e. number 8. The group is told to pass the ball in the sequence identified by numbers 1 through 8 in FIG. 7 without dropping the ball. If there are fewer than eight participants P, then any similar sequence to the one indicated in FIG. 7 may be employed. It is preferred that once the participants P are able to complete the sequence without dropping the ball, other objects such as additional balls or toys should be added to the sequence without warning to participants P. The objective of this activity is for the participants P to manage in the face of chaos, to focus, to stay alert, to communicate and to stay attentive to other participants.

Another activity as part of our present portable educational system is speed ball, not shown. Participants P arrange themselves similar to the arrangement for chaos toss and pass a ball to one another as fast as they can in the same sequence identified above for chaos toss. The passing of the ball is repeated by participants P to attempt to perform the passing sequence faster than the previous attempt. The objectives of this activity is to elicit creativity and empower teamwork to achieve what appears to be unachievable.

Another activity as part of our present portable educational system is paradigm shifter, not shown. Participants P and group facilitator F stand in a circle facing each other. Facilitator F begins by transferring a ball to one participant P. Participants P continue to transfer the ball around the circle from person to person as many times as possible. Participants P can not use the same technique or resource, such as fingers, hands, feet, elbow, shoe, etc., for receiving the ball more than once. Facilitator F begins by transferring the ball with his or her hands, thus eliminating the use of hands thereafter. Play continues until facilitator F is ready to stop to discuss the results of the activity (i.e. debrief) with participants P. The objective of this activity is to leave the restrictions of the paradigm through creative and cooperative teamwork and to exceed initial expectations.

Another activity as part of our present portable educational system is entitled blindfold walk, not shown. All participants P are blindfolded except for leaders, preferably two or three participants P. The leaders must carefully guide the blindfolded members of their group from a point A located in an exercise area to a point B also located in the exercise area. The rules of this activity are that leaders should follow a specific pathway or a set of goals described to them by facilitator F. Once given the goals, leaders have about one minute to plan. In addition, leaders are initially not aware that the rest of the participants P are blindfolded. Leaders may not touch or speak to participants P in their group; and participants P must remain in physical contact with one another while traveling from point A to point B. The objective of this exercise is to move and communicate within imposed limits, developing trust, leadership and fellowship.

Another activity as part of our present portable educational system is called blind polygon, not shown. Participants P stand in a circle with all participants P blindfolded. A rope is placed inside the circle and each participant is given a portion of the rope to hold, preferably unequal rope lengths between individual participants P. Without being able to see, participants P must form a polygon specified by the facilitator or chosen by the group of participants P. The objective of this activity is to understand the importance of shared leadership, flexibility, and listening skills.

FIGS. 8 and 9 display an all aboard educational exercising apparatus 10 for use with an activity called all aboard. All aboard 10 comprises a plurality of planks 12, at least one reinforcement member 16, a plurality of connectors 20 and a platform 24.

Plurality of planks 12 is preferred to be four planks. Planks 12 are arranged end to end to form a generally square shape. Connectors 20 are disposed between planks 12 for joining thereof. Planks 12 and members 16 are preferred to be made of aluminum or other light-weight metal or suitable material. Planks 12 and reinforcement members 16 are preferred to include slots 13 along its outer surfaces and spanning the length of planks 12 and members 16. Planks 12 and members 16 are preferred to be of a slotted, aluminum extrusion design, such as material #1515-Lite provided by 80/20 Inc., located in Columbia City, Ind. connectors 20 are preferred to be of a design for engaging slots 13 of planks 12 and members 16, such as the angle clips or brackets #15 series 2-hole bracket manufactured by 80/20 Inc. End caps 14 are to prevent accidental abrasions to participants P from planks 12. End caps 14 may be provided by 80/20 Inc., located in Columbia City, Ind., product #1515 end cap. End caps 14 may be made of thicker and/or harder material to reduce damage to the ends.

Platform 24 is attached to planks 12 when planks 12 are arranged end to end to form a generally square shape, for example, thereby forming a top on planks 12. Platform 24 is preferred to be of a generally square shape. Platform 24 is further preferred to be made of ABS plastic. Members 16 are attached to planks 12 with connectors 20. Members 16 are disposed within the square shape formed by planks 12 when planks 12 are arranged end to end. Members 16 are to reinforce or provide further support for platform 24 when participants P are standing on platform 24.

All aboard 10 is preferred to have a plurality of non-skid strips 28 attached to platform 24 to prevent participants P from slipping off of platform 24. All aboard 10 is further preferred to include a handle 32 disposed along a side of one of planks 12 for facilitating the ease of transporting all aboard 10.

FIG. 13 illustrates a broken perspective view of plank 12, without end cap 14.

Using all aboard 10, each participant P must have his or her feet off the ground at the same time for a specific time period and no part of any participants P body may be touching the ground. The object of the all aboard activity is to cooperate, support one another's ideas, plan, trust and be trusted, and accomplish a task within specific time limits.

Another activity as part of our present portable educational system is connection walk, not shown. Participants P form a line. Facilitator gives each person a portion of a rope to hold, creating varying lengths of rope between each individual participant P. The person in the front of the line is designated as the leader and must lead the entire group of participants P to a destination identified by facilitator F. Facilitator F only discloses the destination location to the first several participants P in the line. Participants P may not touch any other portion of the rope other than what they were given to hold. The rope between each participant P must not touch the ground. The object of connection walk is to learn the value of sharing information, cooperating, listening to feedback, and providing accurate directions.

FIG. 11 illustrates another activity as part of our present portable educational system called amoeba walk. Participants P stand in a circle 36 facing each other. Participants P are blind folded. The group of participants P must pick up a rope 40 and move together as an amoeba (rope 40 is the "cell membrane"). Circle 36 of participants P must find a box 44 placed at some distance within an exercise area from the original starting point of circle 36. All participants P must stay within circle 36, and rope 40 should never touch the ground. The objective of this activity is to develop planning and organizational skills, flexibility, leadership and team work.

FIG. 12 depicts an arrangement for two activities, namely adding machine and alphanumeric challenge. A rope 48 is laid out to form a circle and alphanumeric mats 52 are arranged randomly within side rope 48. Mats 52 are preferred to have two sides with letters on one side, as shown, and numbers on the other.

For the activity adding machine, mats 52 are placed within rope 48 with the number side facing up so participants can view the numbers. Participants must take turns touching mats 52 in sequential, increasing order. One participant steps into rope circle 48 and maneuvers among mats 52 touching only the appropriate mat 52. After completing the task, he or she leaves rope circle 48. Participants P may not touch more than one mat 52 when they enter the rope circle 48. Individual participants P are not to enter the rope circle 48 twice in a row, but take turns with other participants P. The object of the activity is to accomplish the task as quickly as possible without penalties. The goal of the activity is to make participants P plan, share, develop responsibility, pay attention, listen, and calmly and accurately meet the challenge under time restraints.

The alphanumeric challenge is very similar to the adding machine activity but in this activity, participants are assigned math, spelling and/or other curricular problems. Mats 52 are placed with either the number side or letter side facing upwards according to the assigned goal.

FIG. 13 depicts an activity called quicksand or minefield. This activity is set up by arranging a plurality of mats 56 in a grid pattern 58. Facilitator F should designate several of mats 56 as "quicksand" mats or "mine" mats 60.

With this activity, participants P attempt to cross grid pattern 58. All participants P are blindfolded except two or three designated leaders. All blindfolded participants P must cross grid 58. Facilitator F selects, as mentioned above, the "quicksand" mat 60 but does not disclose this information with participants P. Blindfolded participants P may move forward, diagonally, or side to side. If any one participant steps on to a "quicksand" mat 60, he or she must go to the end of the line and the leaders lose the ability to touch or speak. If the leaders lose both abilities and the last "quicksand" mat 60 is used, then one of the leaders becomes blind and must move to the end of the line. The objective of this activity is to develop trust, communication and planning skills for navigating through a problem.

FIG. 14 depicts an activity called islands. The activity utilizes a plurality of islands 64 and a plurality of stepping stones 68. It is preferred that the activity also utilize all aboard box 10, basically as large island. It is preferred that islands 64 be made of rubber mats. It is further preferred that stepping stones 68 be of smaller mats, handkerchiefs or the like. Participants P must cross an imaginary river stepping only on islands 64 and stepping stones 68, and/or allaboard box 10. Accessing the next stepping stone by participant P is earned by answering a question provide by facilitator F. For example, stepping stone 68 might be earned by offering an answer to a curricular question or a solution to peer pressure, a problem, conflict, or an obstacle that might keep the person from achieving his or her goal. After earning a stepping stone 68, that participant P names it or says what that particular stepping stone 68 represents. To step on a stepping stone 68 which has a name, each participant P must repeat the name or what that particular stone 68 represents. If a participant P steps into the water, i.e. not on a stepping stone 68, island 64 or all aboard box 10 all of the participants P must start over. The objective of this activity is to teach participants P to listen, remember, share, and contribute as a team, as well as to support and trust one another.

FIGS. 15–17 display a big foot educational exercising apparatus 70 for use with an activity called big foot. Big foot 70 comprises at least two planks 72, a plurality of sliders 76 and a plurality of handles 80.

Planks 72 are preferred to be made of aluminum or any other light-weight or suitable metal or material. Planks 72 are preferred to include two slots 74, namely t-slots, in its top surface 81 and bottom surface 82, and one slot 74 in its sides 83, with all slots 74 being coextensive with the length of planks 72. Planks 72 are preferred to be of a slotted, aluminum extrusion design, such as material #1530-Lite provided by 80/20 Inc.

Each slider 76 has two ends 77. Ends 77 are preferred to be threaded for mating with nut member 86. A preferable nut member 86 is produced by 80/20 Inc., identified as economy t-nuts. Sliders 76 are preferred to be of a u-shaped design and configured to allow ends 77 to engage two slots 74 in top 81 of planks 72. Nuts 88 allow slider 76 to be slid into slots 74 but prevent slider 76 from being pulled away from plank 72 by any force directed substantially upward from top 81.

Handles 80 are configured to attach to sliders 76 and extend at least long enough to reach a hand of the participant P. Handles 80 are preferred to be made of rope and simply tied to handles 80.

Slotted end caps 88 are attached to the ends 73 of planks 72. Slotted end caps 88 are specially designed to have grooves or slots 89 that correspond to slots 74 in planks 72. Conventional end caps do not have slots to align with slots 74 of planks 72. Slotted end caps 88 when attached to planks 72 will allow equipment or hardware, such as sliders 76, to easily engage slots 74 of planks 72 without having to remove end caps 88. Conventional end caps require removal in order to slide equipment on to the planks. Slotted end caps 88 are preferred to be glued to ends 73 of planks 72. However, it is contemplated that end caps 88 may be provided with apertures for screwing or bolting end caps 88 to ends 73. Additionally, it is contemplated to use hardware, not shown, configured for engagement with slots 74, to act as a stops, i.e. preventing sliders 76 from sliding off of planks 76.

The big foot activity utilizes big foot 70. Participants P stand in a line each with one foot on one plank 72 and the other foot on the other plank 72. Participants P hold a handle 80 in each hand for balance and to move planks 72. For example, a participant P should hold in his right hand, a handle 80 that is linked to a slider 76 located adjacent his right foot. With the participants P in this arrangement, the team of participants must walk from a given point A to a given point B using planks 72 as two "big feet". The participants P must start over if any member steps off of planks 72. The objective of this activity is to persevere in reaching a destination, lead, follow, support and cooperate as well as to walk together as a team.

FIGS. 18 and 19 display an adjustable bridge box exercising apparatus 90 for use with multiple activities as will be discussed below. Bridge box 90 comprises a plurality of planks 92 and a plurality of connectors 98.

Plurality of planks 92 are preferred to comprise four planks of similar characteristics. Planks 92 are arranged end to end to from a generally square shape. Connectors 98 are disposed between planks 92 for joining thereof. Planks 92 are preferred to include two slots 93 being coextensive with the sides 96 of planks 92. Planks 92 are further preferred to include one slot 93 on the top 94 and bottom 95 of planks 92. Planks 92 are preferred to be of a slotted, aluminum extrusion design, such as material #1515 lite provided by 80/20 Inc., located in Columbia City, Ind.

Connectors 98 are preferred to be of a design for engaging slots 93 of planks 92, such as the angle clips or brackets, product 15 series 4-hole inside corner bracket, produced by 80/20 Inc.

As can be seen in FIG. 19, planks 92 are adjustable to alter the square area 99 confined within planks 92. FIG. 19 displays in phantom lines one plank 92 being adjusted to position 100 and thus reducing area 99.

Planks 92 are preferred to include slotted end caps 104. End caps 104 are identical to and have the same advantages as the previously discussed end caps 88, shown in FIG. 16. Planks 92 are preferred to have a length of about seven feet.

Another activity as part of our present portable educational system is entitled the box which utilizes adjustable bridge box 90 and is shown in FIG. 18. A facilitator F divides the group of participants P into pairs 106. Pair 106 should be about equal in strength, height, etc. Individual participants P of pair 106 begin on opposite corners of box 90 with a rope 107 stretched between them as their only source of support. Pair 106 must traverse the perimeter of box 90 and start over if they fall off box 90. As a modified embodiment of this activity, participants P may be blindfolded. The objective of this activity is to develop team skills, communication, trust and creative problem solving.

Still another activity as a part of our portable educational system is an activity entitled "doctor!doctor!", not shown. This activity also utilizes the adjustable bridge box 90. A bucket, full of candy, is placed in the center of box 90. One of the participants P is selected as a "doctor". All the participants P except the "doctor", contract a "deadly disease" as he or she steps onto box 90. Participant who contract the "disease" first, will die first. Only the "doctor" can obtain the remedy in the bucket, but the "doctor" cannot touch the ground. The "doctor" must get the bucket and distribute the remedy before it is too late. Once a participant P has been cured, he or she can then assist the "doctor" in distributing the remedy. All of the participants P must be in physical contact with one another the entire time. If a participant P falls off box 90, the "doctor" is then blindfolded. The objective of this activity is to develop team skills, communication, trust and creative problem solving.

Yet another activity as part of our portable educational system is entitled "boxed bridge", not shown, which also utilizes adjustable box bridge 90. Participants P divide as each participant steps on to box 90, one person going to the left, the next person to the right until every participant P is on box 90 and the first two individuals that got on box 90 are facing each other. Participants P pass each other, continuing to move on box 90 to the point or location where they initially stepped on. All participants P must stay in physical contact with one another and if a participant P falls or steps off box 90, then all the participants P will have to start over. The objective of this activity is to develop team skills, communication, trust and creative problem solving. Note, additional handicaps may be used, such as blindfolding some of the participants P.

Another activity as part of our portable educational system is entitled "lost coin", not shown, that also utilizes adjustable bridge box 90. Participants P step on box 90 and move around to make room for all participants P. Facilitator F unexpectively tosses a coin into area 99 of box 90. The participants P must then locate and retrieve the coin. All participants P must stay in physical contact with one another and if a participant P falls or steps off box 90, then the entire team of participants P must start over, or facilitator F may impose a relevant handicap to that member, such as blindfolding. The objective of this activity is to develop team skills, communication, trust and creative problem solving.

Figure 20A:
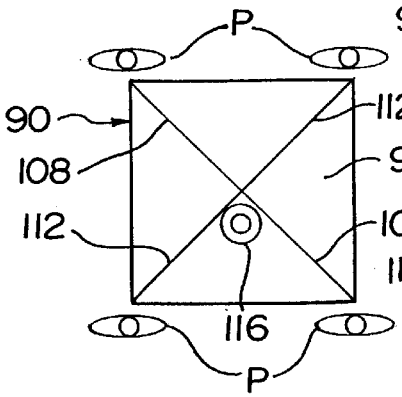
FIG. 20*a* is a schematic representation of an activity entitled out of the box.
Figure 20B:
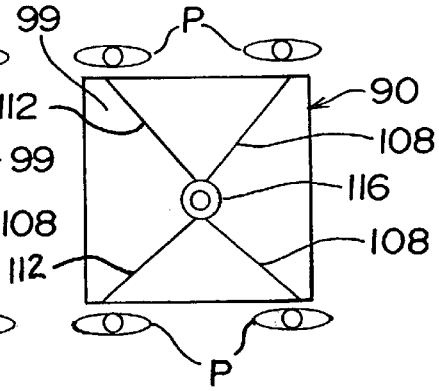
FIG. 20*b* is a schematic representation of a modified out of the box activity.

Another activity as part of our present portable educational system is entitled "out of the box", shown in FIGS. 20*a* and 20*b*. The out of the box activity also utilizes adjustable bridge box 90. FIGS. 20*a* and 20*b* show two alternative modifications to this activity. This activity includes the use of a first rope 108 and a second rope 112 as well as an item 116, which may be, for example, an empty 2-liter plastic bottle. Two pairs of individual participants P stand on box 90 with each pair holding either rope 108 or 112. Item or bottle 116 is placed in area 99 of box 90. Participants P must work together utilizing ropes 108 and 112 to move item 116 outside of box 90. Participants P cannot touch item 116 nor can 116 be dragged across the floor. Item 116 must be lifted outside box 90. Ropes 108 and 112 are not allowed to touch the floor in area 99.

If a participant P falls off box 90, all the participants P start over and one participant is then blindfolded. The objective of this activity is to develop team skills, communication, trust, and creative problem solving.

Figures 21, 22:
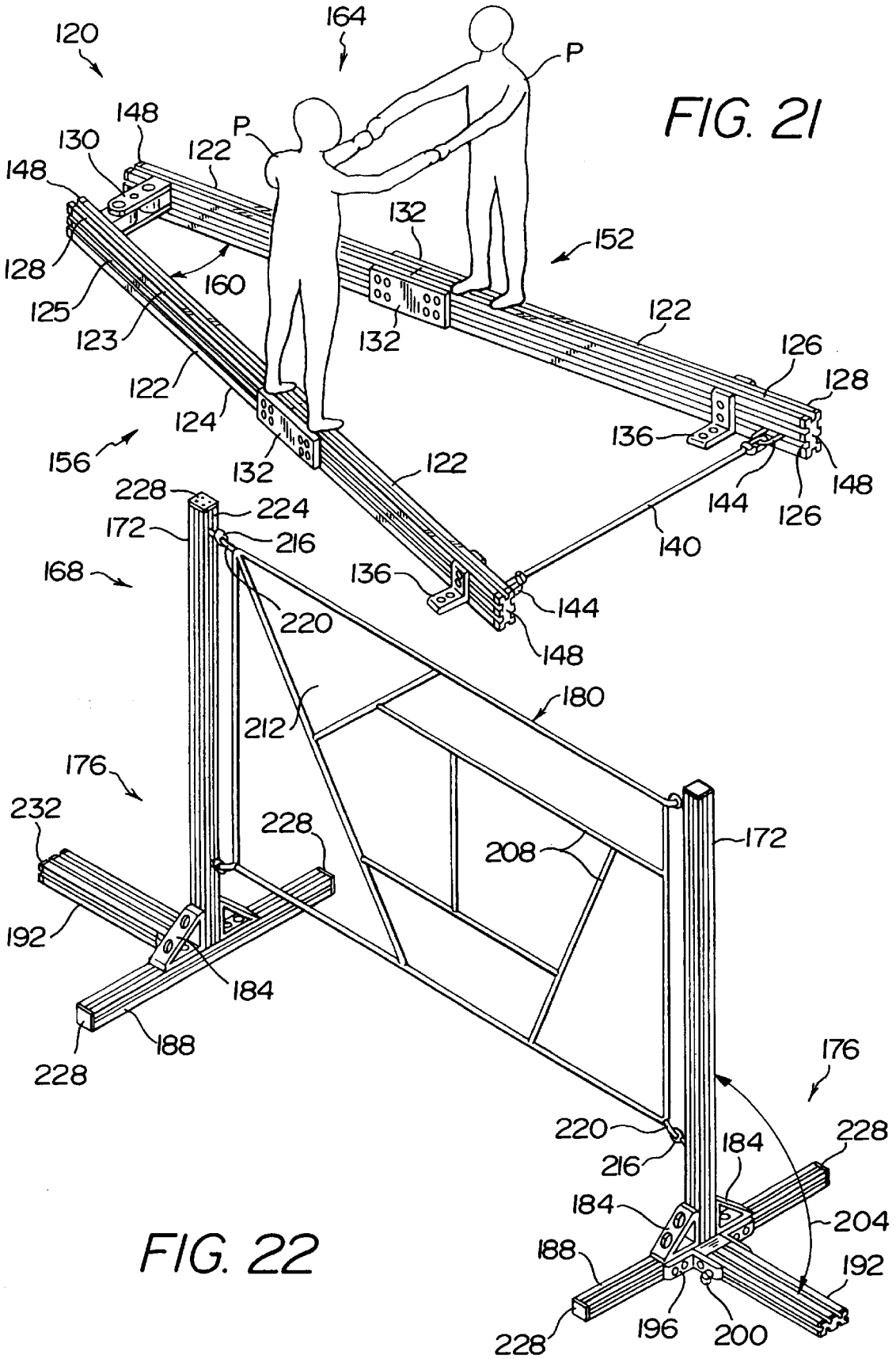
FIG. 21 is a perspective view of a trust vee educational apparatus with the participants shown in schematic form.
FIG. 22 is a perspective view of a spider web educational apparatus.

FIG. 21 displays a trust vee exercising apparatus 120 for use with an activity entitled "trust vee". Trust vee apparatus 120 comprises at least two planks 122 each having a length, a top 123, a bottom 124, side 125, a two ends 128. Trust vee 120 also comprises a pivot joint 130 and a plurality of connectors 136 and a prevention device 140.

Plurality of planks 122 is preferred to be 4 planks. Planks 122 are arranged into pairs 152 and 156. Each pair, 152 and 156 has a similar arrangement of planks 122. Each pair 152 and 156 is arranged where an end 128 of one plank 122 is abutted against an end 128 of another plank 122, forming a first pair or side 152 and second pair or side 156. Each pair 152 and 156 are identical.

To join planks 122 in a pair arrangement, a plurality of spliced plates 132 are used. Planks 122 are preferred to have two slots disposed on and coextensive with the length of sides 125 of planks 122. It is further preferred that planks 122 also include a slot on top 123 and bottom 124 of the planks 122, extending the length thereof. Planks 122 are preferred to be of a slotted, aluminum extrusion design, such as material number 1515-Lite provided by 80/20 Inc. Spliced plates 132 are configured to engage slots 126 on sides 125 of planks 122 with a portion of its length on one plank 122 and the remaining portion on the other abutting plank 122. Spliced plates 132 may be manufactured by 80/20 Inc., product identification: 15 series 8-hole joining plate.

Connectors 136 are similar to all the connectors previously mentioned, however here, they are not used to join two planks 122. Rather, connectors 136 are employed as support feet to prevent planks 122 from tipping. Connectors 136 are preferred to be configured for engaging slots 126 of planks 122. Connectors 136 may be devices such as angle clips or brackets manufactured by 80/20 Inc., product identification: 15 series 4-hole inside corner bracket.

Pivot joint 130 may also be provided by 80/20 Inc., product identification: 15 series 0° pivot nub plus 15 0° living nub pivot and pivot arm kit.

Angle 160 is the angle between the first pair of planks 152 and second pair of planks 156. Prevention device 140 is configured to prevent angle 160 from increasing beyond a pre-determined or pre-selected adjustable maximum angle. Prevention device 140 is attached near end 128 of a plank 122 in first pair 152 and near end 128 of plank 122 in second pair 156. Prevention device 140 is preferred to be a rope or an equivalent thereof. When using a rope, as a prevention device 140, eyebolts 144, are disposed on one plank 122 of each pair 152 and 156, with rope 140 tied to eyebolts 144. Eyebolts 144 are configured for slidably engaging slots 126.

It is further preferred that slotted end caps 148 be attached to ends 128 of planks 122. Slotted end caps 148 are identical to and provide the same advantages as the previously identified slotted end caps 88 above.

To perform the trust vee activity, a pair of participants 164 step onto top 123 of planks 122, with one participant P on first pair of planks 152 and the other participant P on second pair of planks 156. The object of this activity is to have the pair of participants 164 begin near pivot joint 130 and traverse with one participant on each side 152 and 156 toward prevention device 140. Pair of participants 164 are to remain in contact with each other during the traversing or crossing. The maximum open portion or distance between first and second pair 152 and 156 is designed to be greater than the reach of pair of participants 164. The objective of this activity is to have participants P experience and develop a deeper understanding of trust, emphathetic listening, and integrity.

FIG. 22 displays a spider web exercising apparatus 168 for use with the spider web activity. Spider web apparatus 168 includes a plurality of uprights 172, a plurality of feet 176 for supporting uprights 172 and a web 180 disposed between uprights 172. Spider web apparatus also includes a plurality of connectors 184 for connecting feet 176 to uprights 172.

Uprights 172 are preferred to be of a material that is light-weight. Preferably, uprights 172 are to be made of a slotted aluminum extrusion, such as a product identified as 1010-Lite provided by 80/20 Inc.

Each foot 176 comprises a first member 188 a second member 192 and a universal pivot connector 196 joining second member 192 to first member 188. Members 188 and 192 are preferred to be of a light-weight material. First member 188 is preferred to have a generally square cross section. First member 188 is preferred to be of a slotted, aluminum extrusion design, such as material identified as 1515-lite provided by 80/20 Inc. Second member 192 is preferred to have a generally rectangular cross section. Second member 192 is preferred to be of a slotted aluminum extrusion design, such as material identified as 1530-lite extrusion manufactured by 80/20 Inc. Universal pivot connector 196 connects second member 192 to first member 188 at about the mid-length of first member 188. Second member 192 may be attached to joint 196 with a larger side of second member 192 disposed adjacent the floor so as to provide more stability.

Connectors 184 connect one upright 172 to first member 188, as shown in FIG. 22. Universal pivot connector 196 is provided with a quick release pin 200 in order to allow second member 192 to be folded toward upright 172 as indicated by arrow 204, when quick release pin 200 is pulled out from universal pivot connector 196. With second member 192 folded adjacent upright 172 spider web apparatus 168 occupies less storage space and is more easily moved from one location to another.

Universal pivot joint 196 may be provided by 80/20, Inc., product identification: 15 Series 311 Universal Pivot. connectors 184 may also be provided by 80/20 Inc., product identification: 10 to 15 Series 4-Hole Inside Corner Bracket.

Web 180 is attached to uprights 172. Web 180 includes a plurality of interior dividing lines 208. Within dividing lines 208 are areas 212. It is preferred that interior dividing lines 208 be adjustable to increase and decrease areas 212. It is preferred that web 180 be of a nylon material or an equivalent.

Web 180 includes at its four corners a ribbon 220 having disposed thereon a series of hook and loop fasteners. To mate with ribbons 220, eyebolts 216 are provided with a button cover having disposed thereon a series of hook and loop fasteners. Eyebolts 216 are slidably engaged within slots 224 of upright 172. Eyebolts 216 are adjusted in height along uprights 172 to mate with ribbons 220 of web 180.

While in use, one may employ weights on second member 192 in order to prevent tipping of uprights 172. Such weight may be a sand bag.

End caps 228 are attached to one end of uprights 172 and to the ends of first member 188. Slotted end caps 232 are attached to at least one end of second members 192. End caps and slotted end caps 228 and 232, respectively, are identical to the respective end caps and slotted end caps previously discussed.

The spider web activity utilizes spider web apparatus 168. Prior to using spider web apparatus 168, participants P should ensure that web 180 is taut between uprights 172. Each participant P must pass through a web opening, an area 212, without disturbing web 180. If web 180 moves while participants P are attempting to pass through it, all the participants P must start over.

Participants P may not go around or over the top of web 180. Participants P may not dive through an area 212. Once one area 212 has been used by a participant, it "closes" and stays "closed" until all areas 212 have been used by participants. Then all areas 212 open again. As a safety feature, eyebolts 216 and ribbon 220 are used with hook and loop fasteners (VELCRO™) so if a participant P falls into web 180, web 180 will release from uprights 172 without uprights 172 collapsing toward the falling participant P. The objective of the spider web activity is to develop planning, problem solving, team work, collaboration, and shared leadership skills and to practice perserverence as well as to clarify group and individual values.

FIG. 23 displays a bridge exercising apparatus 236 for utilization with the bridge activity. The bridge exercising apparatus 236 comprises the plurality of planks 240, corner brackets or support feet 252 and a plurality of splice plates 256.

Planks 240 are identical to planks 122 identified previously for trust vee exercising apparatus 120 shown in FIG. 21. It is preferred that plurality of planks 240 be four planks. It is further preferred that each plank 240 be of about a seven foot length. The four planks 240 should be arranged in a first pair 244 and a second pair 248. The pairs 244 and 248 are arranged so that each plank 240 is adjacent the other plank 240 and coextensive therewith, as shown in FIG. 23. Pairs 244 and 248 are then abutted against one another at their ends to form one long bridge. Splice plates 256 are used to join first pair 244 to second pair 248 similar to how splice plates 132 are used in the trust vee apparatus 120. Splice plates 256 are identical to the previously identified splice plates. Corner brackets or support feet 252 are also used at various positions along the length of pairs 244 and 248 to prevent bridge apparatus 236 from tipping. Corner brackets 252 are identical to previously identified corner brackets 136 for the trust vee apparatus 120 in FIG. 21.

It is further preferred that slotted end caps 260 be attached to at least the exposed ends of planks 240. The slotted end caps 260 are identical to and provide the same advantages as previously identified slotted end caps.

The bridge activity utilizes the bridge apparatus 236. Participants are divided into two groups. One group begins on one side of bridge apparatus 236 and the other group on the other side of bridge apparatus 236. Each group must cross bridge apparatus 236 while passing the other group. Participants in each group must stay in physical contact with one another during the entire crossing of bridge apparatus 236. If any participant steps off or touches the ground, both groups must start over. The objective of this activity is to promote cooperation and communication with others in reaching a common goal.

Another apparatus used as an activity as part of our portable educational system is the "zig zag" or "swamp walk" apparatus and activity shown in FIG. 24. The zig zag apparatus 262 comprises a start mat 264, a finish mat 270, a plurality of intermediate mats 274 and a plurality of beams 278.

Finish mat 270 is disposed at a distance from start mat 264. Intermediate mats 274 disposed between start mat 264 and finish mat 270 with intermediate mats 274 being separated from each other forming a plurality of gaps 282. The area 286 between start mat 264 and finish mat 270 is an imaginary swamp with intermediate mats 274 placed in a pattern leading from first mat 264 to finish mat 270.

The participants P must cross swamp 286. The participants P must use the limited number of beams 278 to connect the mats in succession starting with start mat 264 and successively crossing or bridging from one intermediate mat 274 to another intermediate mat 274, and so on until finish mat 270 is reached. As beams 278 are added from one mat 274 to another, beams 278 should touch end to end or closely thereto, on mats 274. Participants P must cross beams 278 together, maintaining contact with each other and possibly sustaining other various handicaps such as loss of vision, voice and/or use of limbs. To modify this activity, plurality of beams 278 may be provided with varying lengths. The objectives of this activity are to teach participants to plan and actively experiment to accomplish a difficult task, and to develop a high performance team.

FIG. 25 displays beam 278. Connectors 290 are attached to beam 278 for stability. Connectors 290 are identical to connectors 252 for bridge 236, in characteristics and in the way they attach to beam 278. As an option, elastic band, not shown, may be placed about beam 278 in order to protect any ground surface that it may come in contact with.

Another activity as a part of our present portable educational system is entitled space launcher, shown in FIG. 26. Participants are divided into 2 teams, team 1 comprising of participants P1 and team 2 comprising participants P2. One team comprising of participants P1 stands in a circle and a bungee cord 292 of significant length, preferably about 75 feet, stretches around participants P1 criss-crossing between them to form the same number of holes in a web-like pattern as there are participants P2 outside the circle. In FIG. 26, there are 7 participants P2 outside the circle and there are seven corresponding spaces or holes 298 numbered 1 through 7. Bungee cord 294 should be about hip height on participants P1, approximately 30 inches above the ground.

This space launcher activity has 2 parts. First, participants P1 design the web and participants P2 fill spaces 298 according to the rules set forth below. Participants P2 must move into a space 298 of his or her own without going under bungee cord 294. When all spaces 298 are filled, participants P1 must switch with participants P2 in spaces 298. In other words, participants P1 have to remove themselves from bungee cord 294. If a participant moves bungee cord 294 while moving to his or her space 298, all the participants must start over. Once a space 298 is filled by a participant, no other participant can step into that particular space 298. The objective of this activity is to develop boundary awareness, trust, willingness to ask for and to give support, to problem-solve and learn creativity.

Figure 27A:
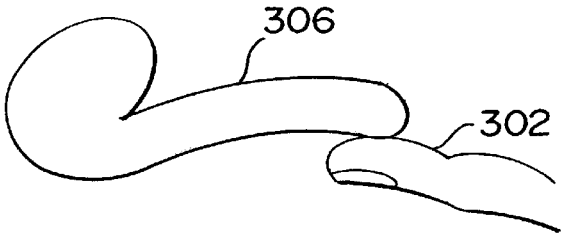
FIG. 27*a* is schematic representation of an activity entitled sky hook; and, FIG. 27*b* is schematic representation of the solution for the sky hook activity.
Figure 27B:
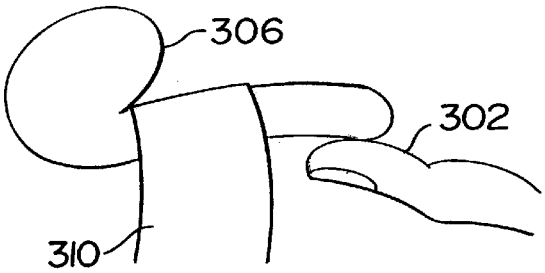

Another activity as part of our present portable educational system is entitled "sky hook", shown in FIGS. 27*a* and 27*b*. The objective of this activity is to balance on the tip of a Participant's index finger 302 a sky hook device 306. Facilitator F, not shown, explains to participants P that everyone has the resources to balance sky hook device 306 on their finger 302, but they must have the knowledge and skills to complete the task. In order to balance sky hook device 306 on a finger 302, participants P must be able to think of using some weighting device 310, as shown in FIG. 27*b*, placed over sky hook device 306. An example of weighting device 310 is a belt, which most participants P will have available to them. The objective of this activity is for participants to evaluate knowledge, skills and resources necessary for task completion.

It is critical for the purpose of this invention that the above-identified activities and apparatuses be of portable nature so as to make it more convenient for individuals to own and utilize an adventure-based educational system.

Accordingly, it is preferable to use as minimal an amount of materials as possible to get the maximum amount of exercise equipment and activities. The following is a listing of the materials needed for the preferred activities and apparatuses.

For the zig zag apparatus and activity, and also for a smaller version of big foot apparatus or an unequal adjustable bridge box, the following materials are needed:

4 planks of extruded aluminum t-slot (1.5 inches by 3 inches) measuring 6½ feet, 6 feet, 5½ feet, and 5 feet; and "hardware" including 16 angled brackets with 32 screws and nuts.

For the big foot apparatus, trust vee apparatus, bridge apparatus and the adjustable bridge box events and apparatus, the following materials are needed:

Four planks of extruded aluminum t-slot (1.5 inch by 3 inches) measuring 7 feet; "hardware" including angled brackets with screws and nuts, 4 solid plates with 8 screws and nuts per plate, 2 and 5 sixteenths inch eyebolts and nuts; 12 foot length of one quarter inch nylon braided rope; 14 sliding u bolts (sliders); and one heavy-duty hinge.

For the all aboard apparatus and activity:

One 24 inch by 24 inch box constructed from extruded aluminum t-slot (1.5 inch by 1.5 inch); and ABS material for the top surface thereof.

For the spider web apparatus and activity:

Two collapsible stands constructed from extruded aluminum t-slot (1.5 inch by 1.5 inch and 1.5 inch by 3 inch); "hardware", including 2 snap pins, 4 eyebolts and nuts with hook and loop fasteners (VELCRO™); and pre-tied adjustable spider web with hook and loop fastener tabs.

For the adding machine and alphanumeric challenge activities, the following materials are needed:

Thirty 6 inch by 6 inch plastic mats with numbers 1 through 30 on one side and letters A through Z on the other side.

In addition to the above listed items, this portable educational system may include the following items for various activities:

5 rubber balls;

1 rubber spider;

15 blind folds;

16 18 inch by 18 inch rubber mats;

1 200 foot ⅜ inch nylon braided rope;

1 12 foot ⅜88 inch nylon braided rope;

2 12 foot ¼ inch nylon braided rope;

75 foot bungee cord; and stop watch.

In addition to providing these materials to create apparatuses and activities for the present educational system, individuals will need to be trained in accordance with the rules of the activities. In addition, individuals will need to be trained on how to better utilize the table in FIGS. 1 through 6 above for their particular participants.

While this invention has been described as having a preferred design, it is understood that it is capable of further modification, uses and/or adaptions following in general the principal of the invention and including such departures from the present disclosure as come within known or customary practice in the art to which the invention pertains, and as may be applied to the essential features set forth, and fall within the scope of the invention or the limits of the appended claims.

We claim:

1. A portable system for multiple educational activities for participants, comprising:

a) a first plank having ends and a length;

b) a second plank having ends;

c) one of said ends of said first plank being positionable adjacent to one of said ends of said second plank, and said first plank being selectively adjustable in relation to said second plank to at least one of defining an angle between said first and second planks and abutting said one of said ends of said first plank to said one of said ends of said second plank;

d) a third plank having ends and a length;

e) a fourth plank having ends;

f) said first and third planks having an integral slot along their length;

g) said first, second, third and fourth planks being connected and defining an area;

h) two connectors; and, i) one of said connectors being connected to one of said ends of said fourth plank and operably engaged with said integral slot of said first plank, the other of said connectors being connected to the other of said ends of said fourth plank and operably engaged with said integral slot of said third plank, thus enabling movement of said fourth plank relative to said second plank to increase or decrease said area.

2. A portable system as recited in claim 1, further comprising:

a) a plurality of connectors disposed on said first plank, providing additional stability for said first plank.

3. A portable system as recited in claim 1, further comprising:

a) a pivot joint joining one of said ends of said first plank to one of said ends of said second plank.

4. A portable system as recited in claim 3, further comprising:

a) a safety device removably attached to one of said ends of said first plank and one of said ends of said second plank and opposite said pivot joint, for limiting said angle to a predetermined safe degree.

5. A portable system as recited in claim 1, further comprising:

a) a platform disposed on said first, second, third and fourth planks and substantially covering said area.

6. A portable system as recited in claim 1, wherein:

a) said length of said third plank is greater than said length of said first plank.

7. A portable system, as recited in claim 1, wherein:

a) said first plank is aluminum.

8. A portable system, as recited in claim 1, wherein:

a) said second plank has a length;

b) said fourth plank has a length; and, c) said lengths of each of said first, second, third and fourth planks are unequal in dimension.

9. A portable system, as recited in claim 1, wherein:

a) said area is generally square.

10. A portable system, as recited in claim 1, further comprising:

a) a carrying handle disposed on said first plank.

11. A portable system, as recited in claim 1, further comprising:

a) a fifth plank; and, b) said fifth plank disposed between said first and third planks, and between said second and fourth planks.

12. A portable system, as recited in claim 11, further comprising:

a) a platform disposed on said first, second, third, fourth, and fifth planks.

13. A portable system, as recited in claim 12, further comprising:

a) a non-skid strip disposed on said platform.

14. A portable system, as recited in claim 1, further comprising:

a) a container removably disposed within said area.

15. A portable system as recited in claim 1, further comprising:

a) an item removably disposed within said area;

b) a first rope;

c) a second rope; and, d) said first and second ropes positioned across said area and selectively engaging said item.

16. A method for using a portable system for multiple educational activities for participants, comprising:

a) providing a first plank having ends, a length and an integral slot along said length;

b) providing a second plank having ends;

c) providing a third plank having ends, a length and an integral slot along said length;

d) providing a fourth plank having ends;

e) arranging said first, second, third and fourth planks to define an area;

f) providing two connectors;

g) connecting one of said connectors to one of said ends of said fourth plank and connecting another one of said connectors to the other of said ends of said fourth plank; and, h) engaging one of said connectors with said integral slot of said first plank and engaging one of said connectors with said integral slot of said third plank, enabling movement of said fourth plank relative to said second plank.

17. A method as recited in claim 16, wherein:

a. said first plank is aluminum.

18. A method as recited in claim 16, further comprising:

a) providing a plurality of connectors; and, b) removably attaching said connectors to said first plank for additional stability.

19. A method as recited in claim 16, further comprising:

a) providing a pivot joint; and, b) attaching said pivot joint to one of said ends of said first plank and to one of said ends of said second plank.

20. A method as recited in claim 19, further comprising:

a) providing a safety device;

b) removably attaching said safety device to one of said ends of said first and second planks opposite said pivot joint.

21. A method as recited in claim 16, further comprising:

a) providing a platform; and, b) disposing said platform on said first, second, third and fourth planks.

22. A method as recited in claim 16, wherein:

a) said area defined in said arranging step is generally square.

23. An educational activity device comprising:

a) a first plank having ends and integral slots;

b) a second plank having ends and integral slots;

c) a third plank having ends;

d) a fourth plank having ends;

e) said first, second, third and fourth planks being disposed adjacent each other defining an area;

f) at least two connectors, one of said at least two connectors being attached to one of said ends of said third plank, another of said at least two connectors being attached to the other of said ends of said third plank; and, g) said at least two connectors engaging said integral slots of said first and second planks allowing said third plank to selectively move relative to said first, second and fourth planks.

24. An educational activity device, as recited in claim 23, wherein:

a) said first plank has a length;

b) said third plank has a length; and, c) said lengths of said first and third planks are unequal in dimension.

25. An educational activity device, as recited in claim 23, further comprising:

a) a pivot joint, connecting one end of said first plank to one end of said fourth plank.

26. An educational activity device, as recited in claim 23, further comprising:

a) a platform disposed on said first, second, third and fourth planks substantially covering said area.

27. A method of making multiple educational activities, comprising:

a) providing a plurality of planks having ends;

b) providing a splice plate;

c) providing a hinge;

d) selectively arranging one end of one of said plurality of planks adjacent to one end of another of said plurality of planks;

e) selectively rearranging said plurality of planks arranged in the previous steps and removably attaching one end of one of said plurality of planks to one end of another of said plurality of planks with said splice plate;

f) selectively rearranging said plurality of planks arranged in the previous steps and removably attaching said hinge to one end of one of said plurality of planks and to one end of another of said plurality of planks, for selectively adjusting a relative placement between said plurality of planks; and, g) selectively rearranging said plurality of planks arranged in the previous steps and arranging said plurality of planks to define an area.

28. A method, as recited in claim 27, further comprising:

a) providing a platform; and, b) selectively disposing said platform on said plurality of planks.

29. A method, as recited in claim 27, wherein:

a) at least one of said plurality of planks is lesser in a length dimension than other ones of said plurality of planks.

* * * * *